US007146921B2

(12) United States Patent
Fontanille et al.

(10) Patent No.: US 7,146,921 B2
(45) Date of Patent: Dec. 12, 2006

(54) ROTATIONALLY RETRACTABLE PROPELLER

(75) Inventors: Guy Fontanille, Les Adrets (FR); Yan Turner, Antibes (FR); Patrick Delalandre, Mandelieu (FR)

(73) Assignee: Max Power, Cannes la Bocca (FR)

( * ) Notice: Subject to any disclaimer, the term of this patent is extended or adjusted under 35 U.S.C. 154(b) by 0 days.

(21) Appl. No.: 10/507,022

(22) PCT Filed: Mar. 25, 2004

(86) PCT No.: PCT/FR2004/000743

§ 371 (c)(1),
(2), (4) Date: Aug. 18, 2005

(87) PCT Pub. No.: WO2004/092007

PCT Pub. Date: Oct. 28, 2004

(65) Prior Publication Data

US 2006/0060127 A1 Mar. 23, 2006

(30) Foreign Application Priority Data

Apr. 9, 2003 (FR) ..... 03 04375

(51) Int. Cl.
*B63H 25/46* (2006.01)

(52) U.S. Cl. ..... 114/151; 440/54; 440/62

(58) Field of Classification Search ..... 114/151; 440/53, 54, 58, 59, 60, 61 R, 62, 63, 66
See application file for complete search history.

(56) References Cited

U.S. PATENT DOCUMENTS 3,901,177 A * 8/1975 Scott ..... 440/5
3,918,389 A * 11/1975 Shima ..... 440/38
4,242,979 A * 1/1981 Shima ..... 440/38
4,294,186 A * 10/1981 Wardell ..... 114/151
5,108,323 A * 4/1992 Veronesi et al. ..... 440/53
5,152,240 A 10/1992 Fontanille
5,257,952 A 11/1993 Veronesi et al.
6,056,610 A 5/2000 Fontanille

FOREIGN PATENT DOCUMENTS

| | | |
|---|---|---|
| DE | 37 18 222 A1 * | 2/1988 |
| EP | 0612658 | 8/1994 |
| FR | 2652559 | 4/1991 |
| FR | 2741854 | 6/1997 |
| FR | 2798184 | 3/2001 |
| NL | 8700535 | 10/1988 |
| WO | WO97/20733 | 6/1997 |
| WO | WO97/26181 | 7/1997 |
| WO | WO98/30440 | 7/1998 |

* cited by examiner

*Primary Examiner*—Sherman Basinger
(74) *Attorney, Agent, or Firm*—Cohen, Pontani, Lieberman & Pavane

(57) ABSTRACT

A retractable thruster for a surface or submersible vessel, having thruster a propulsion assembly with a rigid structure secured to a cylindrical turbine. The rigid structure contains a motor suitable for rotating at lease one propeller inside the turbine via at least one rotary shaft positioned between the motor and the propeller. The thruster preferably further has a plate for closing the hull placed beneath the turbine and secured thereto, the propulsion assembly being displaceable between a retracted position in which it is at rest inside the hull and a deployed position for providing propulsion in which the propeller is immersed beneath the hull. The propulsion assembly is movable between the retracted and deployed positions by the propulsion assembly moving in a uniformly circular direction about an axis of rotation situated substantially no higher than the level of the hull.

20 Claims, 7 Drawing Sheets

ROTATIONALLY RETRACTABLE PROPELLER

PRIORITY CLAIM

This is a U.S. national stage of application Ser. No. PCT/FR04/000743, filed on 25 Mar. 2004. Priority is claimed on that application and on the following application: Country: France, Application No.: 03/04375, Filed: 9 Apr. 2003.

FIELD OF THE INVENTION

The present invention relates to a thruster that can be retracted into the hull of a surface or submersible vessel.

BACKGROUND OF THE INVENTION

The thruster is particularly intended for installing on the bow and/or the stern of a boat. The function of such thrusters is to provide thrust that is lateral or longitudinal depending on the disposition of the propeller axis relative to the longitudinal direction of the vessel. They enable propulsion to be applied in both directions, thereby enabling a vessel to move omnidirectionally, particularly while maneuvering, and while correcting drift due to wind and current or to residual way.

More particularly, the present invention relates to a retractable thruster for a surface or submersible vessel, the thruster comprising a propulsion assembly comprising a rigid structure containing or suitable for containing a motor driving in rotation at least one propeller placed inside a turbine, via at least one rotary shaft between said motor and said propeller, and preferably a hull closure plate placed beneath said turbine and secured thereto, said propulsion assembly being movable by displacement means between a rest, position A retracted inside the hull, and a deployed position B for propulsion, in which the propeller is immersed beneath the hull.

The propeller axis is generally perpendicular to the axis of the motor, and the motor co-operates with the propeller via a geared angle take-off device comprising a first rotary shaft extending a motor shaft situated on the axis of the motor, said first rotary shaft rotating a second shaft perpendicular to said first rotary shaft and having the propeller mounted thereon.

The angle take-off device, also referred to as a "shoulder", is thus essentially contained in the turbine.

In known manner, the angle take-off device comprises a casing containing two shafts rotating respectively about two perpendicular axes of rotation, and comprising both a first shaft rotated directly or indirectly by said motor and a second shaft driving at least one propeller in rotation, together with mechanical elements such as gearing made up of gearwheels, ball bearings, or smooth bearings, thereby enabling rotation to be transmitted from said first shaft to said second shaft.

Casings of the above type are described in French patent No. 2 798 184 in the name of the Applicant.

The first rotary shaft rotated at its top end by a motor can co-operate in the angle take-off device with one or two perpendicular shafts each rotating a propeller having an axis of rotation extending in the same direction perpendicular to said first rotary shaft(s). When the thruster is provided with two propellers in known manner, the first propeller is a traction propeller boosting the second propeller which is a propulsion propeller, and vice versa by reversing the direction of rotation, providing an assembly that is very effective and that provides thrust symmetrically in both directions.

Retractable thrusters are described in the following patents: FR 2 652 559, FR 2 741 854, and EP 0 863 837.

A retractable thruster includes a device for retracting and extending the propeller relative to the hull.

In EP 0 863 837, a displacement device is described delivering rectilinear up and down movement to the propulsion assembly, enabling the propeller to be retracted into a well within the hull or to be extended beneath the hull. A transverse "antitorque" or "antirotation" plate secured to the thruster is situated inside the well and is of shape complementary to the well so as to prevent the thruster from turning relative to the boat while delivering thrust, where such turning can be the result of a torque effect, hence the term "antitorque plate". The device described in EP 0 863 837 also includes means for preventing the thruster becoming jammed or wedged in its rectilinear up and down movements.

The devices for moving the propulsion assembly as described in EP 0 863 837 present a major drawback, namely the rectilinear displacement of the propulsion assembly within the hull occupies a large volume therein.

In FR 2 652 559, proposals are made for a deformably rotatable trapezoidal device generating rectilinear extension or retraction movement of the propulsion assembly out from or into a well that enables the total volume needed for the thruster to be reduced, particularly in the height direction. Nevertheless, that trapezoidal device with its asymmetrically pivoting arms co-operating with a bracket secured to the turbine enables the propeller axis to be moved in rectilinear manner while the propeller is being extended from or retracted into the well, thus enabling the propeller to be cleared immediately by putting the mechanism into action.

The device for retracting and extending the thruster as described in FR 2 652 559 reduces the space occupied by the thruster, particularly in a vertical direction, since the thruster can be disposed in inclined manner inside the hull and can be deployed outside the hull while remaining inclined.

Devices are also known for retracting and extending the propulsion assembly in which the propeller is cleared not by imparting vertical rectilinear movement to the propeller axis, but by imparting circular movement by pivoting the propulsion assembly about a stationary pivot shaft situated at some height inside the hull. In that device, the propulsion assembly is like a swinging arm with the propeller at its end being moved through a circular movement relative to the pivot shaft at the opposite end of said arm.

It is necessary to extend part of the "arm" outside the hull in order to enable the propeller to be fully extended, thus requiring an opening in the hull that is greater than that needed merely for passing the turbine. That large opening involves large volumes and weight of water being displaced or contained that are excessive and that endanger the mechanical reliability of the propulsion system as a whole, while also increasing the weight at the bow end of the vessel in disadvantageous manner.

OBJECTS AND SUMMARY OF THE INVENTION

The object of the present invention is to provide a thruster with a device for retracting and extending the propeller relative to the hull that combines the advantages of the various devices described in the prior art without presenting the drawbacks thereof.

More particularly, the object of the present invention is to provide a device for retracting and extending the thruster:

- which is mechanically reliable, in particular which avoids phenomena of jamming or wedging while it is in movement; and
- which enables the propeller to be cleared quickly from the well inside the hull while also making it possible to implement an opening in the hull that is as small as possible.

More particularly, another object of the present invention is to provide a thruster including a device for retracting and extending the propulsion assembly that requires a minimum number of components and that is easy to assemble, install on the vessel, and to maintain.

Until now, it has been thought that these two requirements imply providing vertical rectilinear movement to the propeller axis, even though systems proposed in the prior art for imparting vertical rectilinear movement to the propeller axis imply either complex mechanical implementation as in FR 2 652 559, or occupy a large amount of volume inside the hull as in EP 0 863 837, i.e. the drawbacks due to the volume occupied in particular by the displacements of the moving parts through the submerged part of the hull.

That is why another object of the present invention is to provide a device for retracting and extending the thruster that also makes it possible to reduce the total volume needed by the thruster, inside the hull, in particular in a vertical direction.

To do this, the present invention provides a retractable thruster for a surface or submersible vessel, the thruster comprising a propulsion assembly comprising a rigid structure secured to a cylindrical turbine, said rigid structure containing or being suitable for containing a motor, said motor being suitable for rotating at least one propeller inside said turbine via at least one rotary shaft between said motor and said propeller, and preferably further comprising a plate for closing the hull placed beneath said turbine and secured thereto, said propulsion assembly being displaceable by displacement means between a retracted position in which it is at rest inside the hull and a deployed position for providing propulsion in which the propeller is immersed beneath the hull, wherein said displacement means enable said propulsion assembly to be moved between said retracted and deployed positions by said propulsion assembly performing uniform circular movement about an axis of rotation situated substantially at the level of said hull or beneath said hull.

More particularly, said displacement means comprise guide elements suitable for co-operating with said propulsion assembly to enable said propulsion assembly to be moved between said retracted and deployed positions (A, B) by said propulsion assembly describing said uniform circular movement about said axis of rotation situated substantially level with said hull or beneath said hull, said uniform circular movement being determined by the shape of said guide elements.

The term "uniform circular movement of the propulsion assembly" is used to mean that all points of said propulsion assembly move simultaneously at the same angular speed, circularly about a common axis of rotation, such that that propulsion assembly is subjected to no significant movement relative to the main movement of circularly displacing its center of gravity or any other point thereof. In particular, the propulsion assembly does not pivot about itself since it does not include any stationary element, and in particular it does not include any member physically embodying the axis of rotation.

Placing the axis of rotation of said propulsion assembly level with the hull or outside it enables the closure plate and the propulsion assembly secured thereto via the turbine to be cleared immediately from the opening in the hull by a movement that is circular while also enabling the opening in the hull to be as small as possible.

The optimum effectiveness of an axis of rotation that is not physically embodied occurs when said axis of rotation is situated ideally on the outside skin of the hull or beneath it, so that there is no point of the closure plate that moves towards the inside of the hull while the propulsion assembly is being deployed. Nevertheless, in practice, given the operating clearance for the closure plate relative to its housing in the opening in the hull, and in particular relative to an optional peripheral rabbet around the opening in the hull, it is acceptable for the axis of rotation to be located slightly above the level of the hull.

The term "level of the hull" is used to mean the level of the continuous surface of the hull that is in direct contact with the water when said vessel is floating on the surface of the water, and not the level of any indentations or housings that might be formed in the hull and that are not in contact with the water when the vessel is floating on the surface of the water.

The term "substantially at the level of the hull" is thus used herein to mean that the center of rotation may be situated slightly above the inside level of the hull, in particular at a height that corresponds to not more than 50% of the diameter of the cylindrical turbine, and more particularly, in practice, a few centimeters above the hull, i.e. a few centimeters into the inside volume of the hull, and more particularly still up to 10 centimeters (cm) above the inside level of the hull.

In addition, because said axis of rotation is not physically embodied, the propulsion assembly is not secured to a pivot shaft.

From a mechanical point of view, the absence of shaft elements embodying the axis of rotation of the moving propulsion assembly, and because said circular movement is generated by guide elements, i.e. because there are no link arms and in particular no pivot arms providing linkage between said axis of rotation and said propulsion assembly, the operation and the implementation of the device for displacing the thruster is guaranteed to be reliable and simple in operation. This configuration also makes it possible to simplify putting the thruster into place while it is being installed on the vessel and obtaining ideal positioning of the thruster in the hull.

Deploying said propulsion assembly by moving it in rotation enables it to be placed in an inclined manner inside the volume of the hull both when it is in the retracted position and when it is in the deployed position, such that, overall, the volume needed for said thruster inside the hull, particularly in the height direction, can be less than three-fourths the volume needed by a conventional retractable thruster that is deployed by a vertical rectilinear movement. The term "inclined position" is used herein to mean that the longitudinal axis of said rigid structure perpendicular to the transverse axis of said turbine is inclined and/or that the axial plane of symmetry including the or both rotary shafts is inclined.

It will be understood that said closure plate closes said orifice in the hull when said propulsion assembly is in the retracted position. It will also be understood that the shape of said "trap door" reproduces the shape of the hull, thus ensuring proper compliance with hydrodynamic relationships so as to eliminate any sources of parasitic turbulence.

In a preferred embodiment of the thruster of the invention, said guide elements comprise at least one moving first guide element secured to said propulsion assembly describing the same uniform circular movement as said propulsion assembly and suitable for co-operating with at least one stationary second guide elements secured to said hull, said uniform circular movement being imposed by the shape of said guide elements, said first and second guide elements co-operating by displacement of said first guide element relative to said second guide element in order to enable said propulsion assembly to be moved between said retracted and deployed positions (A, B).

The term "secured to the hull" is used herein to mean that when said propulsion assembly is installed inside the hull of the vessel, in particular by being included in a caisson supporting the propulsion assembly and fitted to the top edge of a well, itself fitted inside said hull and having a base surrounding said opening in the hull, said second guide elements are secured to the walls of said caisson and, where appropriate, to the walls of said well, i.e. to the hull itself of the vessel.

This implementation enables said guide elements also to perform a function of supporting said propulsion assembly and/or a function of providing a connection between said propulsion assembly and the hull Said second guide element may be supported, in particular by a structure secured to said hull. The connection between said propulsion assembly and said first moving guide element prevents any substantial movement of said propulsion assembly relative to said first guide element and enables the circular movement of the propulsion assembly to be uniform. The circular trajectory of the movement of the propulsion assembly is imposed by the respective shapes of said first and second guide elements, thus making said movement mechanically reliable and simple to implement.

In a more particular embodiment, said moving first guide element is constituted by a male part forming a slider and secured to said propulsion assembly, and said second guide element is constituted by a female part forming a slideway, said slideway forming a circular arc enabling said first guide element to describe said circular movement inside said second guide element.

In an inverse embodiment, said moving first guide element secured to said propulsion assembly is constituted by a slideway-forming female part and said second guide element is constituted by a slider-forming male part, said slideway forming a circular arc enabling said second guide element to describe said circular movement inside said first guide element.

It will be understood that said first and second guide elements constituted by said male and female parts form complementary parts that co-operate with each other to provide guidance. Said slideway may be constituted by guide rails, notches, or perforations, and the slider(s) may be constituted by elements of finger shape, or in a variant by wheels. It is the shape of the slideway which defines the trajectory of said circular movement and the male slider-forming part constitutes a guided element. Thus, amongst said first and second guide elements, there are both guided elements (referred to above as the male part) and guiding elements (referred to above as the female part).

Also advantageously, and as mentioned above, said propulsion assembly is included in part inside a caisson and is secured thereto, said caisson being fitted on the top edge of a well, itself fitted inside said hull and having its base surrounding said opening in said hull. More particularly, said caissons and wells have side walls defining a space that is substantially in the form of a rectangular parallelepiped.

In an advantageous embodiment and in order to reduce the volume occupied inside the hull, said propulsion assembly is inclined in such a manner that a plane containing the longitudinal axis of said rigid structure containing said rotary shaft is inclined in the retracted position (A) relative to the junction plane between said caisson and said well at an angle $\alpha$ of value lying in the range 10° to 60°, preferably in the range 10° to 30°, and is inclined in the deployed position (B) relative to the same junction plane at an angle $\beta$ of value lying in the range 45° to 100°, and preferably in the range 60° to 90°.

In a preferred embodiment, said guide elements comprise a plurality of said first and second guide elements disposed laterally on either side of said propulsion assembly on either side of a vertical plane containing the longitudinal axis of said rigid structure.

Said guide elements may comprise a plurality of sliders disposed on either side of said propulsion assembly and co-operating with a plurality of slideways disposed on either side of said propulsion assembly, said slideways being secured to said hull.

The term "plurality" is used herein to mean that said first and second guide elements comprise at least two said first guide elements and at least two said second guide elements, with at least one of said first guide elements or at least one said second guide elements on either side of said propulsion assembly.

Still more particularly, said second guide element(s) is/are included in or associated with one or more plates mounted in stationary manner on a side wall of said caisson, or on opposite side walls of said caisson.

In a preferred embodiment, said first guide elements comprise at least three male parts, preferably three sliders disposed in a triangle, symmetrically on either side of said propulsion assembly so as to co-operate respectively with at least two slideway-forming female parts defining concentric circular arcs that are geometrically similar and disposed symmetrically on either side of said propulsion assembly, at least two of said male parts, preferably said sliders, being suitable for sliding inside a first slideway of greater radius and at least one third male part, preferably a third slider, being suitable for sliding inside at least one second slideway of smaller radius.

The term "geometrically similar" is used herein to mean that the two circular arcs occupy the same angular sector.

This embodiment provides guidance to the propulsion assembly in highly effective manner, conferring mechanical reliability and stiffness while the assembly is set into movement, while also being very simple to implement.

This embodiment also ensures good mechanical stability to counter the torque effect generated by propulsion when the thruster is in a stage of actively delivering thrust, thereby making it possible to avoid the fatigue stresses that are usually encountered on retractable thrusters and to conserve satisfactory or even exact coincidence between the opening in the hull and the trap door for closing the opening, thereby ensuring that the hull of the boat retains its hydrodynamic performance in full.

Advantageously, said guide elements co-operate with drive means enabling said circular movement of the propulsion assembly relative to the hull to be generated.

Still more particularly, said first or second guide element is turned relative to said second or first guide element in a said circular movement by a motor co-operating, where appropriate, with said first or said second guide element via link elements in such a manner as to enable said propulsion assembly to be blocked in the retracted position (A) or in the deployed position (B), where appropriate.

It will be understood that it is advantageous to turn the elements forming the male part regardless of whether they constitute the first or the second guide elements by making them co-operate via said link elements with drive means.

Finally, in a particular embodiment, said rigid structure comprises a structure in the form of a rectangular parallelepiped providing a leaktight connection firstly with a cover covering said motor, and secondly with said turbine, said first guide elements being mounted against opposite side faces of said rectangular structure.

BRIEF DESCRIPTION OF THE DRAWINGS

Other characteristics and advantages of the present invention appear in the light of the following detailed description of an embodiment given with reference to the accompanying figures, in which.

MORE DETAILED DESCRIPTION

Figure 1A:
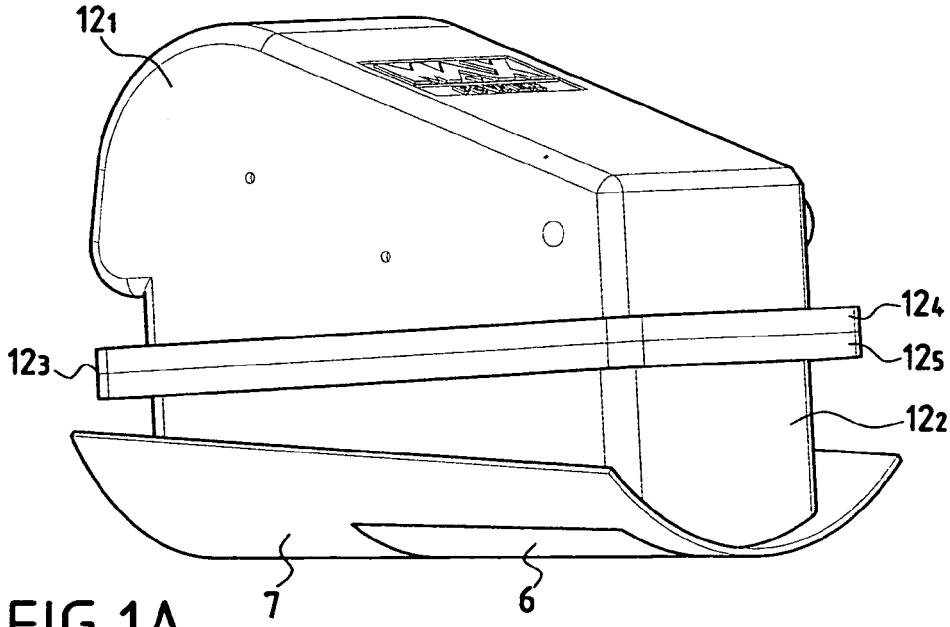
FIGS. 1A and 1B are perspective views of the inside of the hull with a thruster integrated in a caisson and a well, said propulsion assembly (without its propeller) being shown in its retracted position inside the hull in FIG. 1A and in its deployed position outside the hull in FIG. 1B.
Figure 1B:
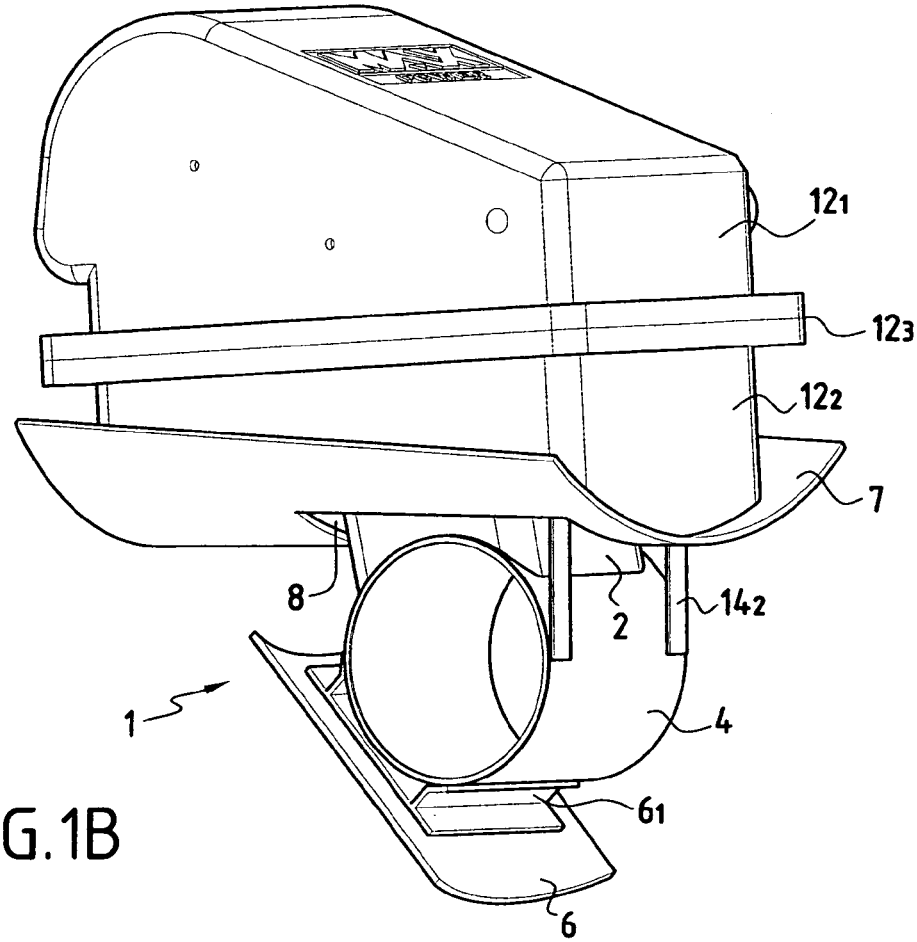

The propulsion assembly 1 of the invention comprises a closed and leaktight rigid structure 2, $\mathbf{2}_1$ secured to a tubular turbine 4.

Said rigid structure 2, $\mathbf{2}_1$ contains a motor (not shown) and a rotary shaft (not shown) for rotating at least one propeller 3, the propeller 3 being contained inside a tubular duct to constitute said turbine 4.

Said rigid structure 2, $\mathbf{2}_1$ is constituted by a structure 2 in the form of a rectangular parallelepiped constituting a box having four solid faces defining a rectangular parallelepiped with an open face at one end that is secured in leaktight manner to the tubular duct of the turbine 4, and having an open face at its opposite end providing a leaktight connection with a rectangular cover $\mathbf{2}_1$ covering the motor of the propulsion assembly and the turbine 4.

The rectangular structure 2 defines a column presenting a longitudinal axis of symmetry LL' corresponding substantially to the axis of the main rotary shaft which is driven directly by the motor inside the structure 2, $\mathbf{2}_1$ and which is connected at its other end to an angle take-off device inside the turbine 4, as described below. The tubular structure constituting the turbine 4 has a transverse axis ZZ' perpendicular to the longitudinal axis LL' of the rectangular structure 2.

The center of the turbine 4 has a shoulder or casing $\mathbf{3}_1$ containing an angle take-off device to provide the connection between the main rotary shaft of the structure 2 extending along the direction ZZ' and connected to the motor inside the cover $\mathbf{2}_1$, and one or two rotary shafts extending in the transverse direction ZZ' and connected to one or two propellers 3 contained inside the turbine 4. A first propeller may operate in traction boosting a second propeller which operates in thrust, or vice versa when the direction of rotation is reversed. This two-propeller system provides propulsion that is very effective with thrust that is symmetrical in the two opposite directions corresponding to the axis ZZ' extending transversely to the longitudinal direction LL' of the thrust assembly and to the longitudinal direction XX' of the boat.

The propulsion assembly 1 is mounted inside a caisson $\mathbf{12}_1$ that is substantially in the shape of a rectangular parallelepiped and co-operating via a leaktight junction lying in a junction plane $\mathbf{12}_3$ with a well $\mathbf{12}_2$ that is substantially in the form of a rectangular parallelepiped and that is made inside the hull, with a cutout 8 being made through said hull 7 inside the well. The propulsion assembly 1 is supported by the upper caisson $\mathbf{12}_1$ having lateral walls with a bottom edge $\mathbf{12}_4$ that is fixed in leaktight manner to the top edge $\mathbf{12}_5$ of the lateral walls of the well $\mathbf{12}_2$. The propulsion assembly 1 is secured to the caisson $\mathbf{12}_1$ but is movable relative thereto, in uniform circular movement as described below.

Figure 2A:
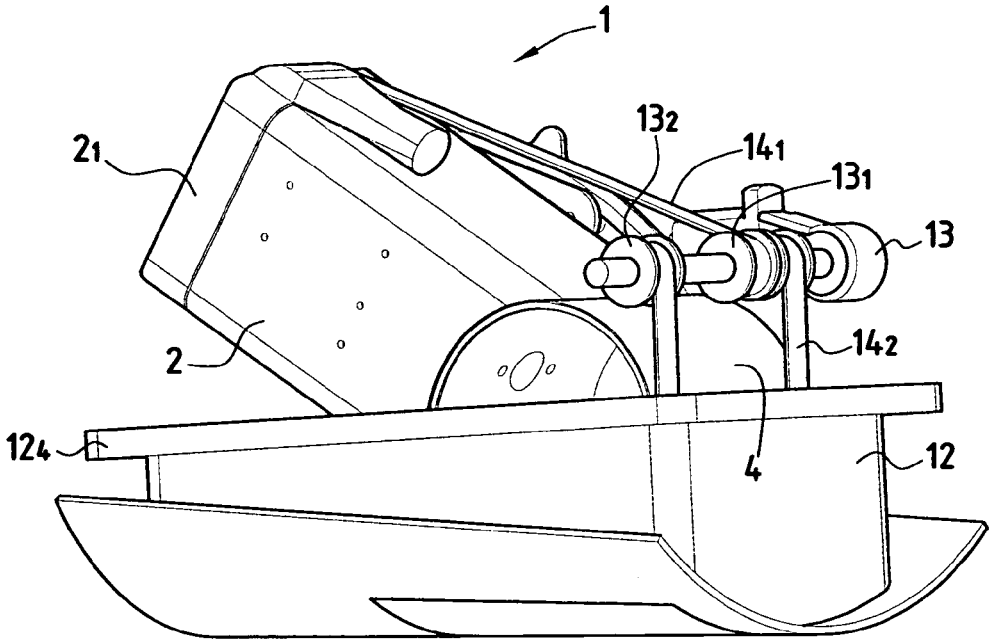
FIGS. 2A and 2B are views corresponding to FIGS. 1A and 1B respectively with the caisson that supports the propulsion assembly being removed so as to show only the well situated above the opening in the hull together with the position of the propulsion assembly (without its propeller) when in the retracted position (FIG. 2A) and in the deployed position (FIG. 2B)
Figure 2B:
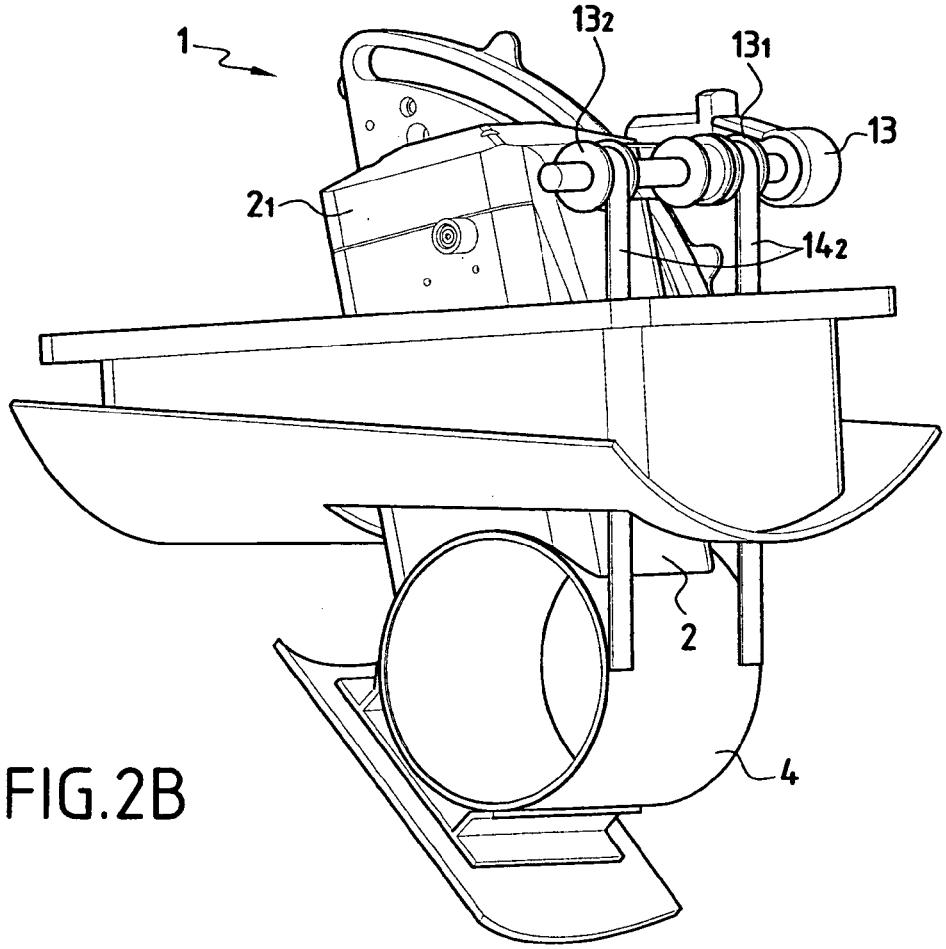

Beneath the turbine 4, a closure plate 6 reproducing the shape of the hull co-operates with a rabbet $\mathbf{8}_1$ (FIG. 4B) around the periphery of the opening 8 in the hull 7 so that in the retracted position (FIGS. 2A and 4B) the plate 6 is in smooth continuity with the remainder of the hull 7. The closure plate 6 is connected to the turbine 4 by support elements $\mathbf{6}_1$.

The propulsion assembly 1 of the invention is retractable by means of a pivoting device which is described below and which imparts circular movement for extending it out from the well and the hull or for retracting it into the well by turning about an axis of rotation 11 situated at the level of the hull 7 (FIGS. 4A to 4C) and not physically embodied by a pivot shaft.

When the propulsion assembly 1 is retracted inside the well $\mathbf{12}_1$, the opening 8 in the hull is automatically closed by the trap door 6 that is secured to the tubular duct of the turbine 4, and the outside shape of the trap door reproduces the shape of the hull 7, thus complying properly with hydrodynamic relationships and avoiding any source of parasitic turbulence.

The pivot device for pivoting between a retracted position A inside the hull and a deployed position B for thrust in which the propeller is extended outside the well and projects beyond and beneath the hull 7 comprises:

male guide elements $\mathbf{9}_1$, $\mathbf{9}_2$, $\mathbf{9}_3$ mounted on faces that are opposite in the transverse direction ZZ' of the rectangular rigid structure 2 and providing a junction between the turbine 4 and the cover $\mathbf{2}_1$. More precisely, sliders $\mathbf{9}_1$, $\mathbf{9}_2$, and $\mathbf{9}_3$ are supported by respective triangular plates 16 mounted on either side of the rectangular structure 2. These sliders $\mathbf{9}_1$, $\mathbf{9}_2$, and $\mathbf{9}_3$ are placed on the plates 16 in a triangular configuration and co-operate with slideways formed by circular slots $\mathbf{10}_1$, $\mathbf{10}_2$ provided in support plates 15 placed facing the plates 16.

The two pairs of slideways $\mathbf{10}_1$, $\mathbf{10}_2$ are disposed symmetrically on either side of said propulsion assembly in co-operation with the sliders $\mathbf{9}_1$–$\mathbf{9}_3$ supported by the two plates 16, each of which is placed on a respective side of said rigid rectangular structure 2.

The two slideways $\mathbf{10}_1$, $\mathbf{10}_2$ thus constitute female parts that co-operate with the male parts $\mathbf{9}_1$, $\mathbf{9}_2$, and $\mathbf{9}_3$.

More precisely, the slideways $\mathbf{10}_1$, $\mathbf{10}_2$ define concentric circular arcs that are geometrically similar, occupying the same angular sector, i.e. inscribed within the same circular section. Still more precisely, a first slider $\mathbf{9}_1$ is suitable for moving inside the first slideway $\mathbf{10}_1$ while the other two sliders $\mathbf{9}_2$, $\mathbf{9}_3$ slide inside a second slideway $\mathbf{10}_2$, defining an arc situated above the first slideway $\mathbf{10}_1$, and defining a circular arc that is concentric with the first slideway but of larger radius and occupying the same angular sector (geometrically similar).

The plates 15 in which the circular slideways $\mathbf{10}_1$ and $\mathbf{10}_2$ are defined are themselves fixed to opposite side edges of the caisson $\mathbf{12}_2$ via second plates $\mathbf{15}_1$. The plates 15 and $\mathbf{15}_1$ are positioned inside the caisson $\mathbf{12}_1$ in such a manner that the circular slideways $\mathbf{10}_1$ and $\mathbf{10}_2$ present a center of circular symmetry that is situated level with the hull 11 (which center corresponds to the center of rotation of the sliders $\mathbf{9}_1$, $\mathbf{9}_2$, and $\mathbf{9}_3$ within the slideways $\mathbf{10}_1$ and $\mathbf{10}_2$, see FIGS. 4A and 4B).

Figure 3:
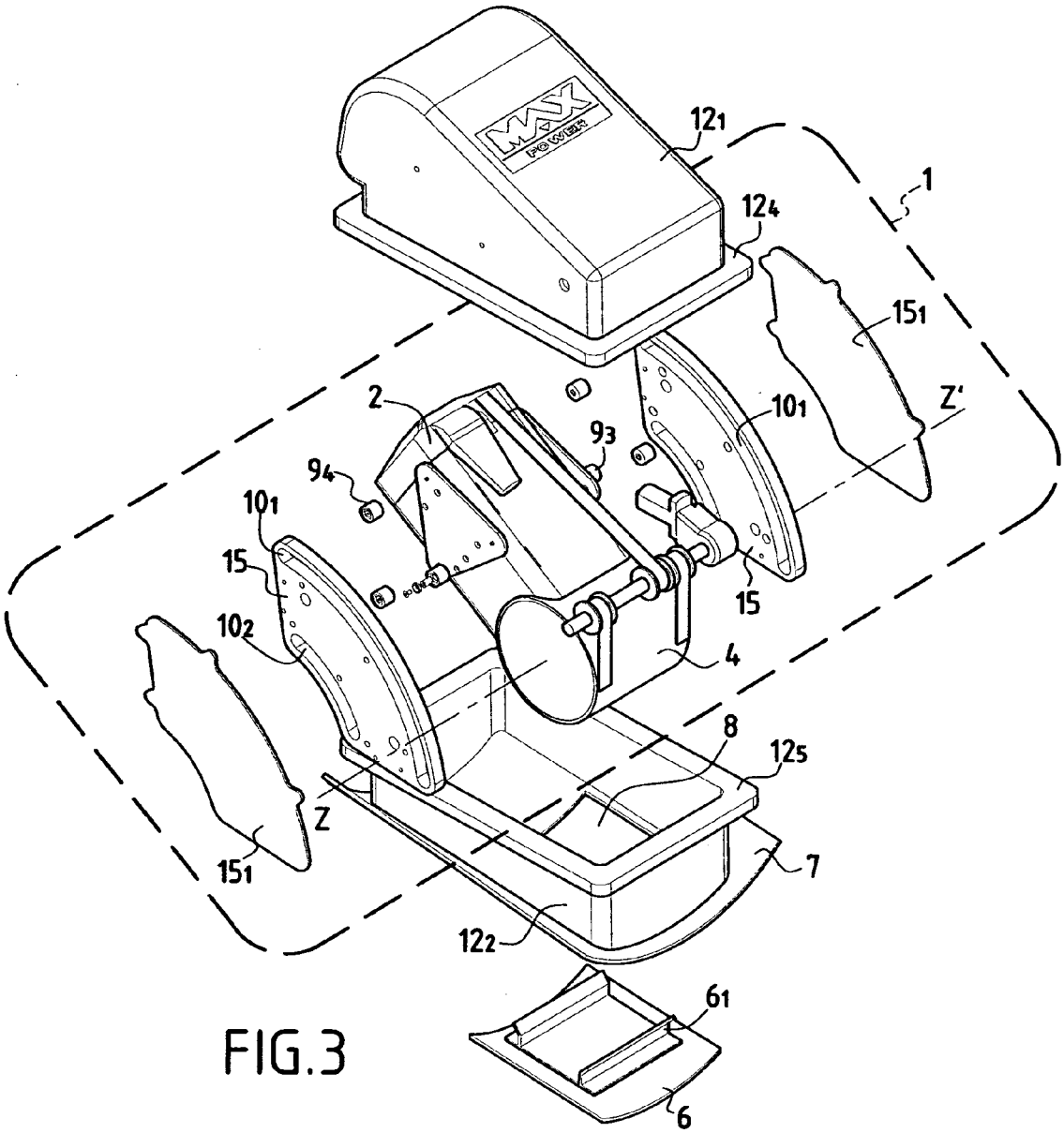
FIG. 3 is an exploded view showing the various component elements of the thruster in the hull together with the propulsion assembly.

The sliders $\mathbf{9}_1$, $\mathbf{9}_2$, and $\mathbf{9}_3$ are constituted by cylindrical fingers surrounded by bushings $\mathbf{9}_4$ (see FIG. 3) making them easier to slide inside the circularly-arcuate slots constituting the slideways $\mathbf{10}_1$ and $\mathbf{10}_2$.

Figure 8A:
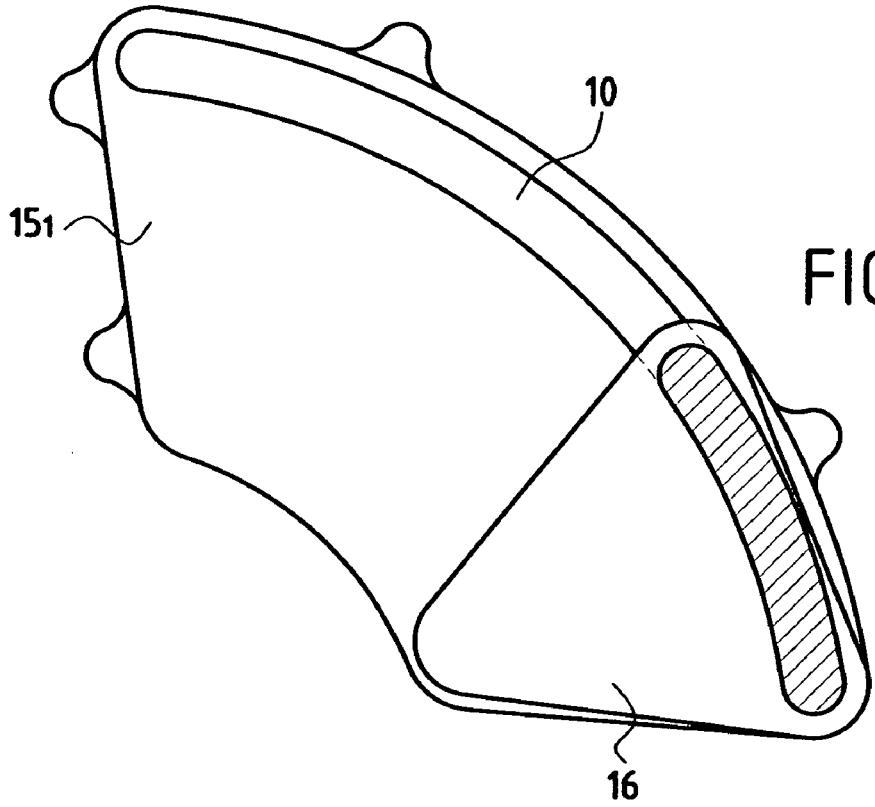
FIGS. 8A and 8B show a variant embodiment of a slider of the invention.
Figure 8B:
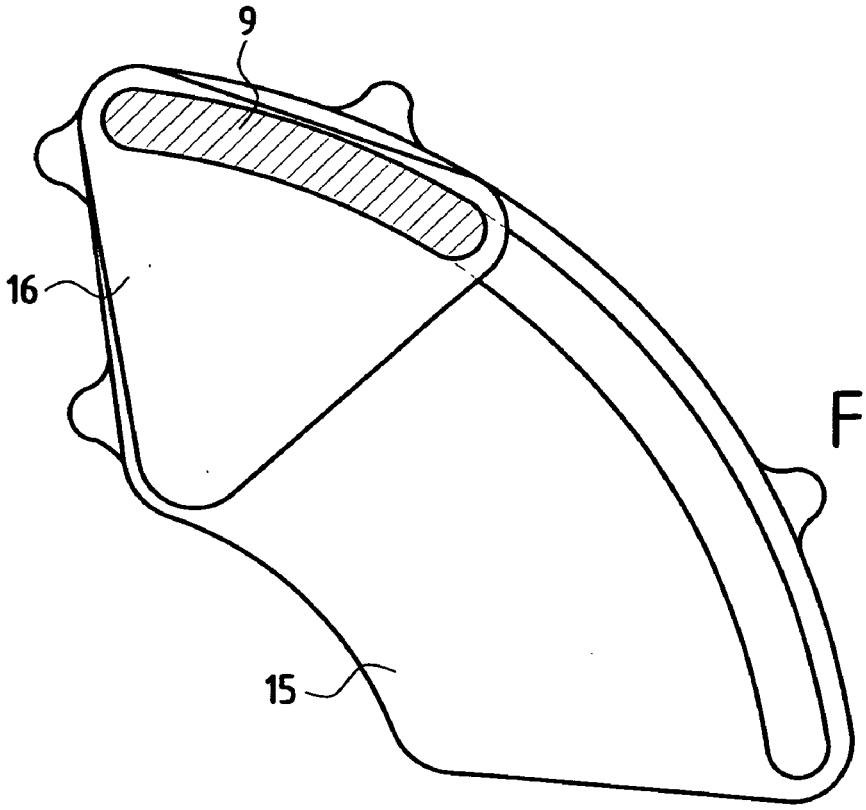

In a variant embodiment shown in FIGS. 8A and 8B, the guide elements comprise a single slider 9 of circularly-arcuate shape corresponding to the slideway that is formed by a circularly-arcuate slot 10. It will be understood that in this FIG. 8 embodiment, it is possible to envisage the plates $\mathbf{15}_1$ that include the slots 10 being secured to the rectangular rigid structure 2 connecting the cover $\mathbf{2}_1$ to the turbine 4 and to envisage the triangular plates 16 supporting the slider 9 being fixed on the side walls inside the caisson $\mathbf{12}_1$.

It will be understood that the disposition of a plurality of sliders $\mathbf{9}_1$, $\mathbf{9}_2$, $\mathbf{9}_3$ co-operating with a plurality of slideways $\mathbf{10}_1$ and $\mathbf{10}_2$ in the first variant embodiment and the form using a single slider 9 co-operating with a single slideway 10 (FIG. 8) in the second variant embodiment both enable the propulsion assembly to be moved in uniform circular manner that is determined by the shape of said guide elements $\mathbf{9}_1$, $\mathbf{9}_2$, $\mathbf{9}_3$ co-operating with the guide elements $\mathbf{10}_1$, $\mathbf{10}_2$. The term "uniform circular movement" is used herein to mean that the propulsion assembly does not turn other than by its main circular turning movement about the virtual center of rotation 11 that is defined by the shape of the guide elements 9, $\mathbf{9}_1$–$\mathbf{9}_3$, and 10, $\mathbf{10}_1$–$\mathbf{10}_2$, which present as their center of circular symmetry said virtual center of rotation 11 of the propulsion assembly 1. In other words, the propulsion assembly 1 moves uniformly when it moves circularly. When the propulsion assembly passes from the retracted position inside the hull (A, FIG. 4A) to the deployed position outside the hull (B, FIG. 4C), this uniform circular movement ensures that the closure plate 6 immediately clears the opening 8 and allows only the turbine 4 with its propeller 3 to pass therethrough, which explains why the opening 3 can be relatively small in size.

The circular movement of the propulsion assembly 1 inside the slideways $\mathbf{10}_1$, $\mathbf{10}_2$ or 10 is imparted by a displacement device comprising:

a motor 13 of the type comprising a motor and gearbox unit co-operating with pulleys $\mathbf{13}_1$, $\mathbf{13}_2$ disposed side by side on a common rotary shaft extending in the transverse direction ZZ' perpendicular to the longitudinal direction LL' of the propulsion assembly 1.

Said pulleys $\mathbf{13}_1$, $\mathbf{13}_2$ receive straps $\mathbf{14}_1$, $\mathbf{14}_2$. A first strap $\mathbf{14}_1$ referred to as the "down" strap has one end fixed to one of said pulleys $\mathbf{13}_1$ and its other end fixed to the top cap $\mathbf{2}_1$. Two second straps $\mathbf{14}_2$ referred to as "up" straps provide respective connections between the pulleys $\mathbf{13}_2$ to which they are fixed by one of their ends, and the turbine 4 to which they are fixed by their opposite ends.

The operation of extending or retracting the propulsion assembly is controlled from outside the caisson by a hydraulic, electrical, or compressed air system (not shown) acting on the motor 13. Actuating the motor 13 causes the pulleys $\mathbf{13}_1$ and $\mathbf{13}_2$ to rotate so as to wind out or wind in the down strap $\mathbf{14}_1$ and conversely to wind in or wind out the up strap $\mathbf{14}_2$, thereby lowering the turbine 4 and thus extending the propulsion assembly into its deployed position B, or respectively raising the turbine 4, and thus enabling the propulsion assembly to be deployed into position B or retracted into position A inside the hull 7.

The non-reversible nature of the motor 13 ensures that the thruster is blocked either in its retracted position A or in its deployed position B at the end of winding out or winding in the straps $\mathbf{14}_1$, $\mathbf{14}_2$.

It should be observed that the rigidity imparted to the propulsion assembly of the invention, firstly by said rigid structure 2, and secondly by the guidance of said propulsion assembly 1 secured to said male elements $\mathbf{9}_1$–$\mathbf{9}_3$ pivoting within the stationary female elements $\mathbf{10}_1$, $\mathbf{10}_2$, ensures that the deformation that is normally due to the torque effect that is generated during a stage of active propulsion is absent, thus making it possible to avoid the fatigue stresses that are usually encountered with retractable thrusters. This rigidity also makes it possible to conserve exact coincidence between the closing trap door 6 and its housing 8–$\mathbf{8}_1$ in the underwater portion of the hull 7, thus ensuring that the hull 7 of the boat retains its hydrodynamic performance.

The motor (not shown) of the propulsion assembly, contained inside the cover $\mathbf{2}_1$ may be an electric motor, a compressed air motor, or a hydraulic motor. By its very design, this propulsion assembly 1 is not subjected to seizing during its movements entering or leaving the well.

Finally, the circular movement of the propulsion assembly makes it possible to reduce the volume it occupies inside the hull insofar as it enables the assembly to be disposed inside the hull so that it is inclined when in its retracted position A at an angle $\alpha$ relative to the junction plane $\mathbf{12}_3$ (XOZ) between the caisson $\mathbf{12}_1$ and the well $\mathbf{12}_2$ having a value lying in the range 10° to 60°, preferably in the range 10° to 30°, and having an angle $\beta$ in the deployed position B having a value of 45° to 100°, and preferably lying in the range 60° to 90° relative to the same junction plane (XOZ) that is substantially parallel to the hull.

The design whereby the propulsion assembly is mounted inside the hull secured to the caisson $\mathbf{12}_1$ makes it easier to position inside the hull.

Figure 4A:
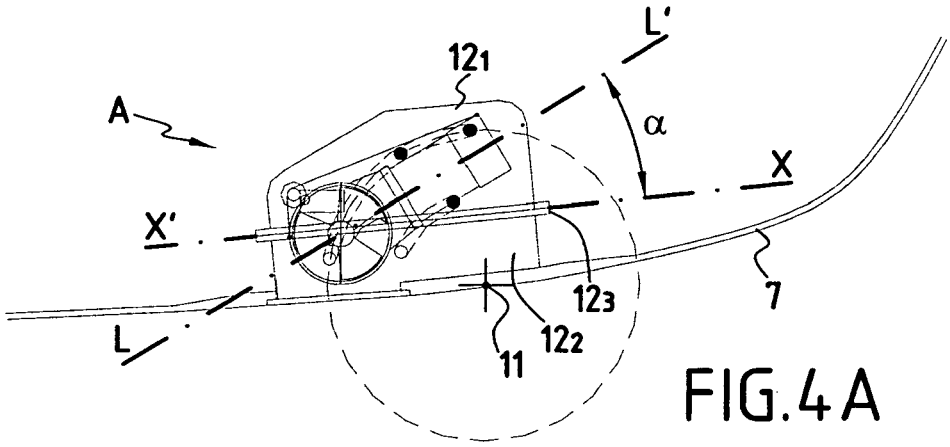
FIGS. 4A, 4B, and 4C are diagrammatic longitudinal section views on the axis of the boat showing a thruster of the invention in the retracted position (FIG. 4A), in the intermediate position (FIG. 4B), and in the deployed position (FIG. 4C)
Figure 4B:
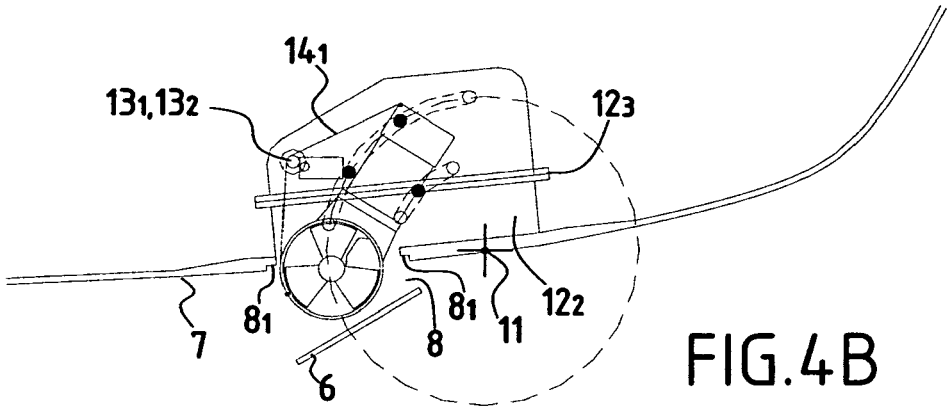
Figure 4C:
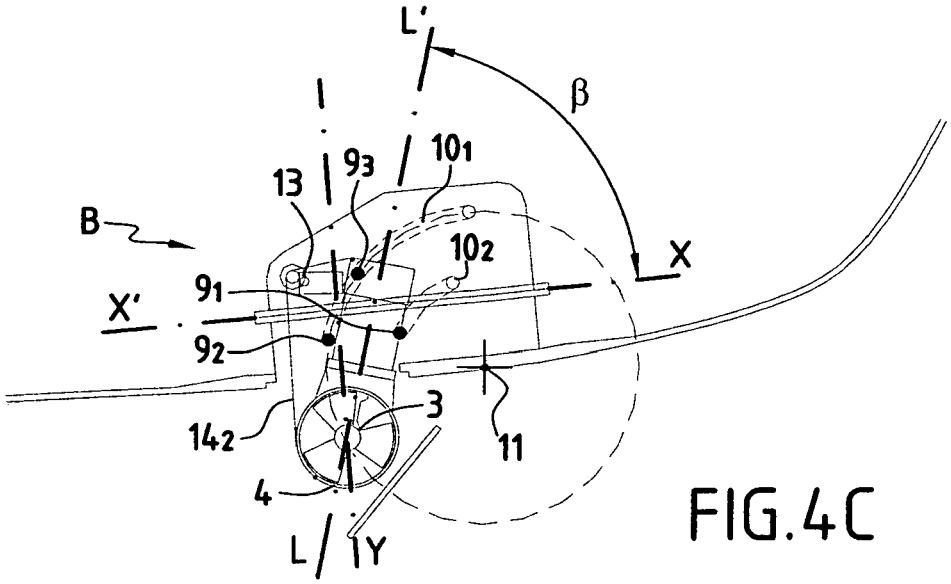
Figure 5C:
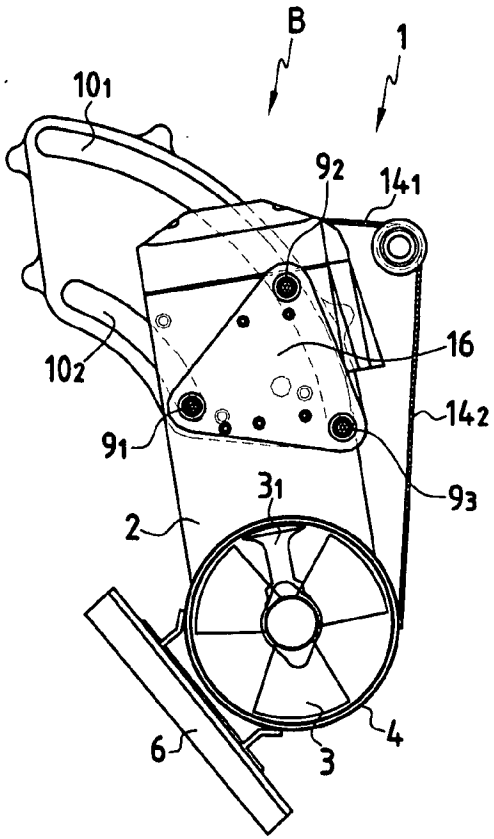
FIGS. 5A, 5B, and 5C show the propulsion assembly in longitudinal view in the positions of FIGS. 4A, 4B, and 4C, respectively.
Figure 5B:
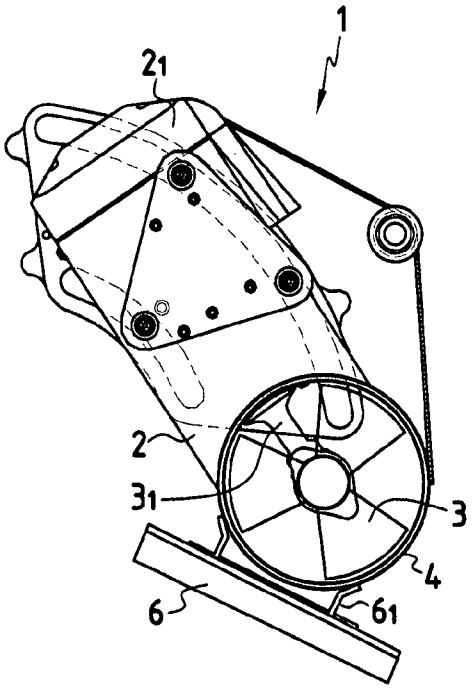
Figure 5A:
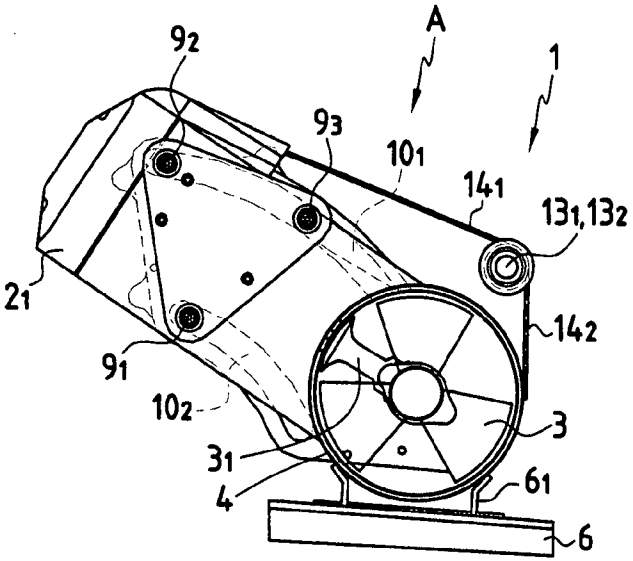
Figure 6:
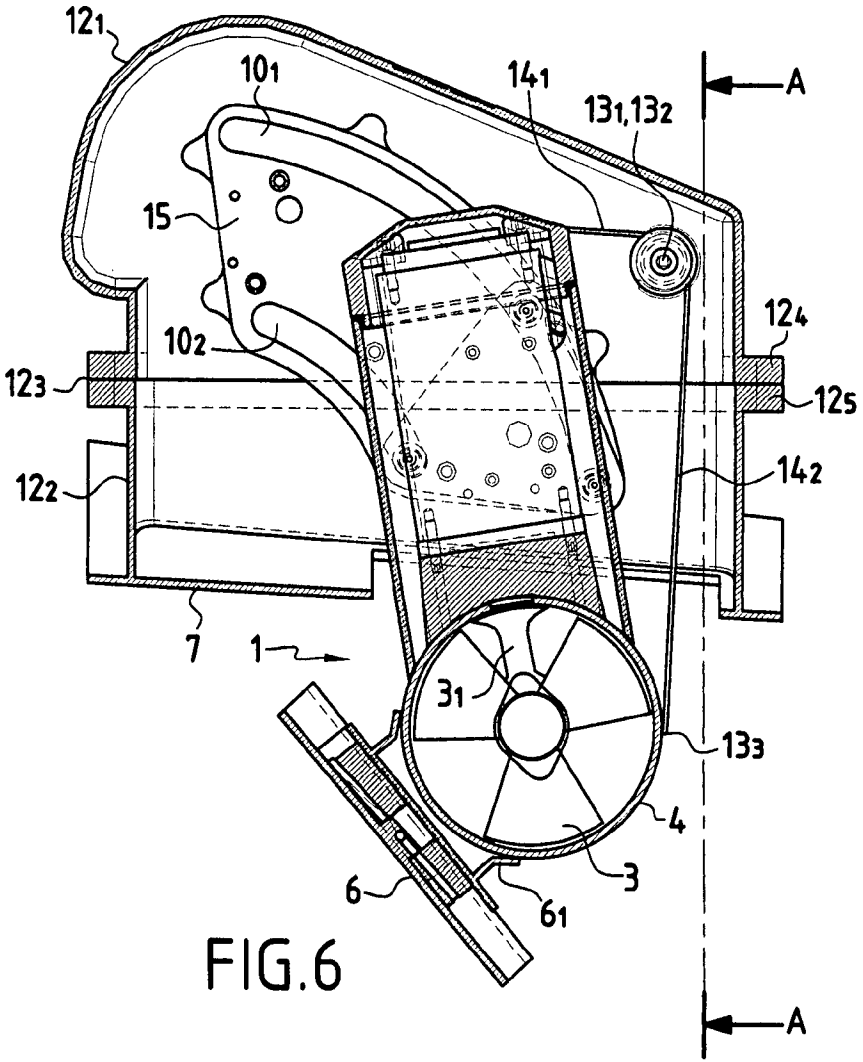
FIG. 6 is a longitudinal section view of a thruster comprising a propulsion assembly integrated in a caisson and a well in the hull of a boat.
Figure 7:
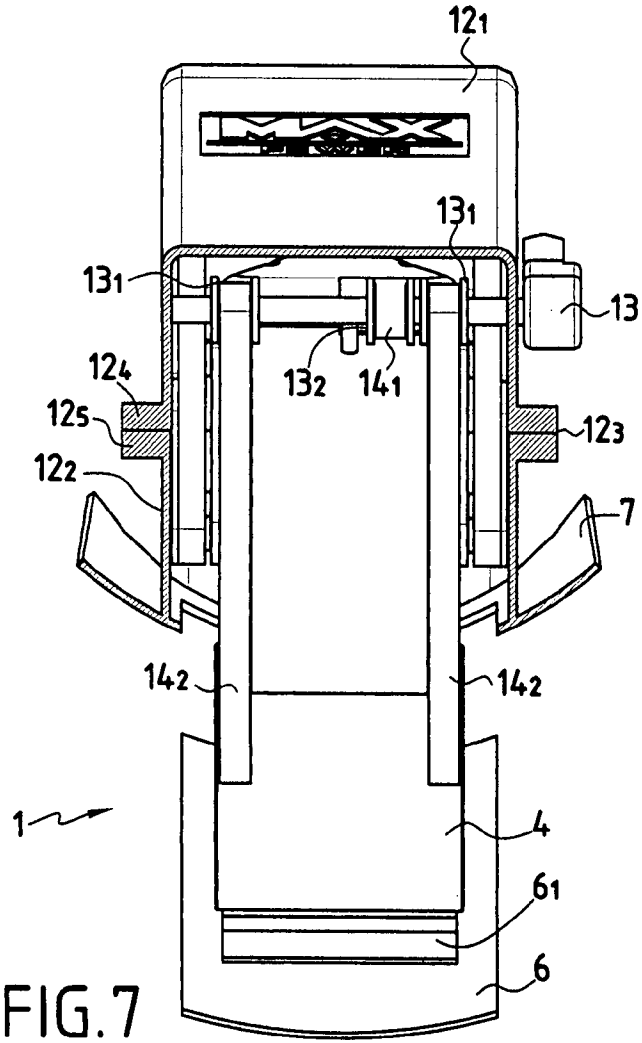
FIG. 7 is a cross-section view on A—A of FIG. 6.

FIGS. 4A and 4C show an axis of rotation 11 situated at the level of the hull, however the axis could equally well be situated below the hull insofar as its position makes it possible for the closure plate 6 to clear instantly the rim $\mathbf{8}_1$ of the opening 8 in the hull 7.

In FIGS. 1 to 8, the propulsion assembly is shown as being disposed inside the hull in such a manner that the axis of rotation of the propeller is a transverse axis ZZ' perpendicular to the longitudinal direction XX' of the boat; nevertheless, the propulsion assembly could naturally be disposed differently inside the hull, in the longitudinal direction of the boat in order to deliver propulsion in a longitudinal direction instead of in a transverse direction.

What is claimed is:

1. A retractable thruster for a vessel having a hull, the thruster comprising:

a propulsion assembly having a propeller and a rigid structure secured to a cylindrical turbine;

a plate for closing the hull, said plate being disposed beneath said turbine and secured thereto; and displacement means to move said propulsion assembly between a retracted position in which it is at rest inside the hull and a deployed position in which the propeller is immersed beneath the hull;

wherein said displacement means enable uniform circular movement of said propulsion assembly between said retracted and deployed positions about an axis of rotation that is not physically embodied in the hull and situated substantially no higher than the level of said hull;

wherein said displacement means include first and second guide elements suitable for co-operating with said propulsion assembly to enable said propulsion assembly to be moved between said retracted and deployed positions by said propulsion assembly about said axis of rotation situated substantially no higher than said hull, said uniform circular movement being determined by the shape of said guide elements;

wherein said first guide element is secured to said propulsion assembly for describing the same uniform circular movement as said propulsion assembly and suitable for co-operating with said second guide element;

wherein said second guide element is stationary and secured to said hull; and wherein said uniform circular movement is defined by the shape of said first and second guide elements, said first and second guide elements co-operating by displacement of said first guide element relative to said second guide element to enable said propulsion assembly to be moved between said retracted and deployed positions.

2. A retractable thruster for a vessel having a hull, the thruster comprising:

a propulsion assembly having a propeller and a rigid structure secured to a cylindrical turbine;

a plate for closing the hull, said plate being disposed beneath said turbine and secured thereto; and displacement means to move said propulsion assembly between a retracted position in which it is at rest inside the hull and a deployed position in which the propeller is immersed beneath the hull;

wherein said displacement means enable uniform circular movement of said propulsion assembly between said retracted and deployed positions about an axis of rotation that is not physically embodied in the hull and situated substantially no higher than the level of said hull.

3. A thruster according to claim 2, wherein said displacement means comprise guide elements suitable for co-operating with said propulsion assembly to enable said propulsion assembly to be moved between said retracted and deployed positions by said propulsion assembly about said axis of rotation, said uniform circular movement being determined by the shape of said guide elements.

4. A thruster according to claim 3, wherein said guide elements comprise at least first and second guide elements, said first guide element being secured to said propulsion assembly for describing the same uniform circular movement as said propulsion assembly and suitable for co-operating with said second guide element, said second guide element being stationary and secured to said hull, said uniform circular movement being defined by the shape of said guide elements, said first and second guide elements co-operating by displacement of said first guide element relative to said second guide element in order to enable said propulsion assembly to be moved between said retracted and deployed positions.

5. A thruster according to claim 4, wherein said moving first guide element includes a male part forming a slider and being secured to said propulsion assembly, and said second guide element comprises a mating female part forming a slideway, said slideway forming a circular arc enabling said first guide element to describe said circular movement by sliding inside said second guide element.

6. A thruster according to claim 4, wherein said first guide element secured to said propulsion assembly includes a female part defining a slideway and said second guide element includes a male part defining a slider, said slideway forming a circular arc enabling said second guide element to describe said circular movement by sliding inside said first guide element.

7. A thruster according to claim 4, wherein said first guide element includes at least first, second and third male parts, symmetrically disposed on either side of said propulsion assembly so as to co-operate respectively with at least first and second female parts defining respective first and second concentric circular slideways that are geometrically similar and disposed symmetrically on either side of said propulsion assembly, said first slideway having a radius greater than that of said second slideway, at least said first and second male parts being suitable for sliding inside said first slideway and at least said third male part, being suitable for sliding inside at least said second slideway.

8. A thruster according to claim 7, wherein said first, second and third male parts are three sliders disposed in a triangle.

9. A thruster according to claim 4, wherein said first guide element includes at least first, second and third male parts, symmetrically disposed on either side of said propulsion assembly so as to co-operate respectively with at least first and second female parts defining respective first and second concentric circular slideways that are geometrically similar and disposed symmetrically on either side of said propulsion assembly, said first slideway having a radius greater than that of said second slideway at least said first and second male parts, being suitable for sliding inside said first slideway and at least said third male part being suitable for sliding inside said second slideway, wherein one of said first and second guide elements is turned relative to the other of said first or second elements in said circular movement by a motor cooperating with said one of said first and second guide elements via link elements so as to enable said propulsion assembly to be blocked in the retracted position or in the deployed position, where appropriate.

10. A thruster according to claim 9, wherein said first, second and third male parts are sliders disposed in a triangle.

11. A thruster according to claim 3, wherein said guide elements comprise a plurality of guide elements, disposed laterally on either side of said propulsion assembly on either side of a vertical plane containing the longitudinal axis of said rigid structure.

12. A thruster according to claim 2, wherein at least a first portion of said propulsion assembly is disposed inside a caisson and is secured thereto, said caisson being fitted on the top edge of a well, and said well being fitted inside said hull and having its base surrounding said opening in said hull.

13. A thruster according to claim 12, wherein said rigid structure has a longitudinal axis, wherein said propulsion assembly is inclined in such a manner that a plane containing said longitudinal axis of said rigid structure is inclined in the retracted position relative to one of the longitudinal direction of the vessel and to the junction plane between said caisson and said well at an angle $\alpha$ of value lying in the range 10° to 60°, and is inclined in the deployed position relative to one of the same longitudinal direction of the vessel and the junction plane between said caisson and said well at an angle $\beta$ of value lying in the range 45° to 100°.

14. A thruster according to claim 13, wherein angle $\alpha$ has a value lying in the range 10° to 30°, and angle $\beta$ has a value lying in the range 60° to 90°.

15. A thruster according to claim 12, further comprising guide elements associated with at least one second plate mounted in a stationary manner on at least one side wall of said caisson.

16. A thruster according to claim 15, wherein said at least one second plate includes at least two second plates, and wherein at least two of said second plates are mounted on opposite side walls of said caisson.

17. A thruster according to claim 12 wherein said displacement means includes guide elements disposed within at least one plate mounted in a stationary manner on at least one side wall of said caisson.

18. A thruster according to claim 17, wherein said guide elements comprise a plurality of said first and second guide elements, disposed laterally on either side of said propulsion assembly on either side of a vertical plane containing the longitudinal axis of said rigid structure.

19. A thruster according to claim 2, further comprising drive means for driving said propulsion assembly in a circular manner relative to the hull.

20. A thruster according to claim 2, wherein said rigid structure comprises a structure in the form of a rectangular parallelepiped providing a leaktight connection firstly with a cover, and secondly with said turbine, and further comprising at least two guide elements mounted against opposite side faces of said structure.

* * * * *